US006973944B2

(12) United States Patent
Anderson et al.

(10) Patent No.: US 6,973,944 B2
(45) Date of Patent: Dec. 13, 2005

(54) COLLAPSIBLE APPARATUS FOR RECOVERING AND DISPENSING LIGHTWEIGHT OBJECTS

(75) Inventors: Keith A. Anderson, Alexandria, MN (US); David J. Schonberg, Alexandria, MN (US)

(73) Assignee: Industrial Components Technology, Inc., Alexandria, MN (US)

( * ) Notice: Subject to any disclaimer, the term of this patent is extended or adjusted under 35 U.S.C. 154(b) by 74 days.

(21) Appl. No.: 10/794,322

(22) Filed: Mar. 5, 2004

(65) Prior Publication Data

US 2005/0194062 A1 Sep. 8, 2005

(51) Int. Cl.[7] ..... B65B 1/04

(52) U.S. Cl. ..... 141/59; 141/369; 141/86; 141/67

(58) Field of Search ..... 141/18, 37, 44, 141/45, 67, 80, 86, 115, 121, 126, 123, 369, 141/311 R, 285, 290; 406/82, 108, 117; 53/239

(56) References Cited

U.S. PATENT DOCUMENTS

| | | | |
|---|---|---|---|
| 1,278,175 | A | 9/1918 | Le Baron |
| 1,471,927 | A | 10/1923 | Schutt et al. |
| 2,744,286 | A | 5/1956 | Carpenter et al. |
| 3,428,098 | A | 2/1969 | Slay |
| 4,043,718 | A | 8/1977 | Takenaka et al. |
| 4,200,415 | A | 4/1980 | Boring |
| 4,599,016 | A | 7/1986 | Medemblik |
| 4,829,724 | A | 5/1989 | Miller, Jr. et al. |
| 4,947,903 | A | 8/1990 | Beckwith |
| 5,000,623 | A | 3/1991 | Kihlström |
| 5,033,914 | A | 7/1991 | Wuertele et al. |
| 5,088,860 | A | 2/1992 | Stockdale et al. |
| 5,096,337 | A | 3/1992 | Denton |
| 5,195,852 | A | 3/1993 | Malugani et al. |
| 5,323,819 | A | 6/1994 | Shade |
| 5,741,093 | A | 4/1998 | Schonberg et al. |
| 5,833,287 | A | 11/1998 | Shade |
| 6,170,118 | B1 | 1/2001 | McIntyre et al. |
| 6,286,569 | B1 | 9/2001 | Brandenburg et al. |

*Primary Examiner*—Steven O. Douglas
(74) *Attorney, Agent, or Firm*—Alan D. Kamrath; Nikolai & Mersereau, P.A.

(57) ABSTRACT

A collapsible apparatus (10) recovers and dispenses packaging material. The collapsible apparatus (10) includes a receptacle (20) that is permeable to air. A disc (30) defines a lower end of the receptacle (20). A collection tube (36) is slideably received in a hole (34) of the disc (30) and has an inlet (38) outside the receptacle (20) and an outlet (40) inside the receptacle (20). A fan (60) is mounted to the disc (30) and communicated with the collection tube (36) to form a vacuum in the collection tube (36). The vacuum pulls the packaging material through the collection tube (36) and deposits the packaging material in the receptacle (20). A discharge valve (81) is a scissors valve that extends through the disc (30) for discharging packaging material from the receptacle (20). The receptacle (20) is collapsible and the collection tube (36) is positionable parallel a surface (32) of the disc (30) while the disc (30) carries the fan (60), the collection tube (36) and the discharge valve (81) to enhance compactibility.

20 Claims, 2 Drawing Sheets

COLLAPSIBLE APPARATUS FOR RECOVERING AND DISPENSING LIGHTWEIGHT OBJECTS

BACKGROUND

The present invention generally relates to recovering and dispensing lightweight objects and more particularly to a collapsible apparatus for recovering and dispensing packaging material.

In recovering and dispensing packaging material, specifically packing peanuts, the packaging material is typically vacuumed up through a flexible tube and stored in a container. The vacuum is generally formed by shop air blown into the flexible tube. Shop air may be inconvenient or unavailable. Alternately, a blower may be mounted external the receptacle to provide the vacuum.

Previous apparatus for recovering packing peanuts required a container and tubing substantially external the container. In combination with an external blower or hook up for shop air, the previous apparatus can be too large to meet standard shipping requirements and therefore cost prohibitive to ship to a customer.

Furthermore, previous apparatus having tubes exterior the collection bag and entering the bag in a variety of locations or from more than one side could be unsightly and cumbersome when in use.

Therefore, there is a need to have a novel apparatus for overcoming the deficiencies in prior manners of recovering and dispensing packaging material.

SUMMARY

The present invention solves these needs and other problems in the field of recovering and dispensing packaging material by providing, in a preferred form, a collapsible apparatus to facilitate the recovery and dispensing of packaging material. The collapsible apparatus has a receptacle that is permeable to air and collapsible. A disc forms a lower end of the receptacle. The disc has a surface that is horizontal. The packaging material in the receptacle gravitationally rests on the surface of the disc. The disc has a hole that slideably receives a collection tube. An inlet of the collection tube is located outside the receptacle and an outlet of the collection tube is located inside the receptacle when the collection tube is received in the hole of the disc. A fan having fan blades inside a fan passageway is mounted to the disc. The fan passageway extends through the disc from outside to inside the receptacle. The fan, when operating, forces air from outside the receptacle through the fan passageway and into the collection tube. The air is forced toward the outlet of the collection tube to create a vacuum at the inlet of the collection tube. The inlet of the collection tube collects the packaging material, and the vacuum created pulls the packaging material through the collection tube when the fan is operating. The outlet of the collection tube deposits the packaging material into the receptacle for storage and future discharge. A discharge passage extends through the disc and has a discharge valve that is moveable between an open position and a closed position. When in the open position, the discharge valve allows discharge of stored packaging material from inside the receptacle to outside the receptacle. The discharge valve effectively blocks the discharge passage when in the closed position to retain packaging material in the receptacle.

In other aspects of the present invention, a collapsible apparatus is provided to facilitate the recovery and dispensing of packaging material. The collapsible apparatus has a receptacle that is permeable to air and has a lower end. The packaging material in the receptacle gravitationally rests on the lower end of the receptacle. A collection tube collects the packaging material and deposits the packaging material into the receptacle for storage and future discharge. A discharge passage extends through the lower end of the receptacle and has a discharge valve that is moveable between an open position and a closed position. When in the open position, the discharge valve allows discharge of stored packaging material from inside the receptacle to outside the receptacle. The discharge valve effectively blocks the discharge passage when in the closed position to retain packaging material in the receptacle. The discharge valve includes a housing that has an axis generally perpendicular the lower end of the receptacle. A slot extends from exterior to interior a periphery of the housing in a plane perpendicular the axis of the housing. The slot has a length along the periphery of the housing in the plane perpendicular the axis of the housing. The discharge valve has at least a first blade that is slidingly mounted in the slot of the housing. The first blade has a first edge, a first handle, and a first pivot point intermediate the first edge and the first handle. The first handle is located exterior the periphery of the housing. The first blade is rotatable about the first pivot point. The discharge valve has a second handle exterior the periphery of the housing. When the discharge valve is in the closed position, the first handle is spaced from the second handle. When an operator presses the first handle toward the second handle, the first blade is rotated about the first pivot point to move the first edge to define the open position of the discharge valve.

Thus, the present invention provides a novel apparatus for recovering and dispensing packaging material.

Additionally, the present invention provides such a novel apparatus that is aesthetically pleasing and trim in contour.

Further, the present invention provides such a novel apparatus that is easily collapsible for enhanced compactibility.

Further, the present invention provides such a novel apparatus that has a disc that forms the lower end of the receptacle and carries the fan, the collection tube, and the discharge valve.

Furthermore, the present invention provides such a novel apparatus that has a discharge valve that is aesthetically pleasing, readily accessible to an operator, and easily manufactured and implemented.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
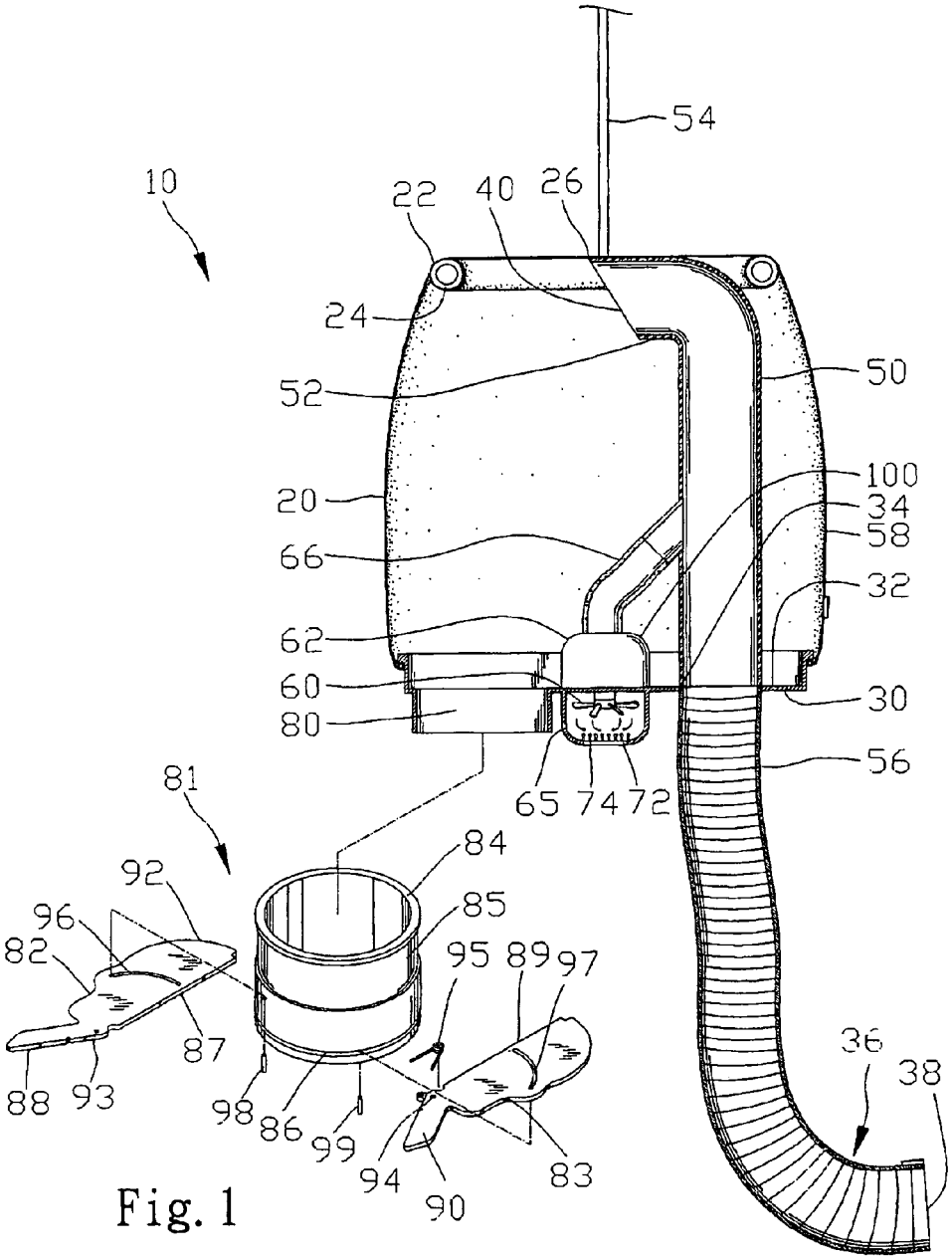
FIG. 1 shows a cross sectional, partially diagrammatic view of a collapsible apparatus for recovering and dispensing packaging material according to the preferred teachings of the present invention, with a discharge valve being exploded therefrom and shown as being exploded and in perspective.
Figure 2:
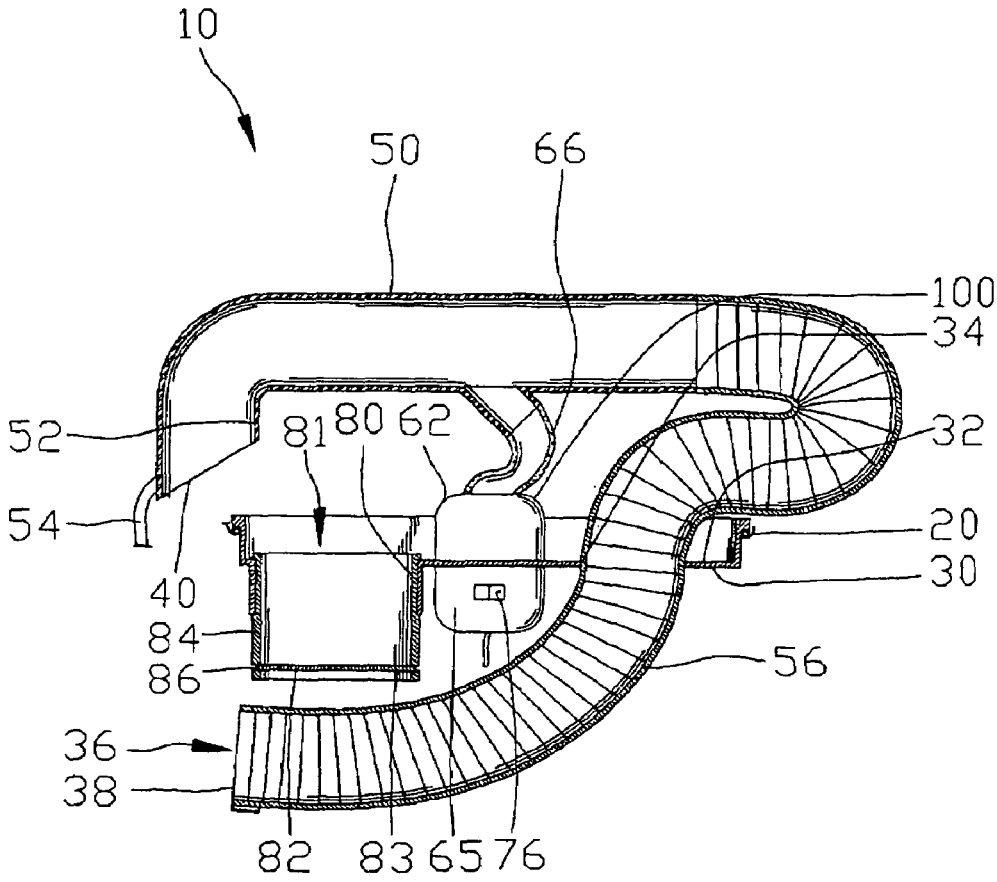
FIG. 2 shows a cross sectional, partially diagrammatic view of the collapsible apparatus for recovering and dispensing packaging material of FIG. 1 with the rigid portion of the collection tube positioned parallel the surface of the disc and with the receptacle being broken away for ease of illustration.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "side," "end," "upper," "lower," "bottom," "top," "interior," "exterior," "inside," "outside", "open," "closed," "vertical," "horizontal," "length," and similar terms are used herein, it should be understood that these terms have reference only to the structure shown in the drawings as it would appear to a person viewing the drawings and are utilized only to facilitate describing the illustrative embodiment.

DESCRIPTION OF THE PREFERRED EMBODIMENT

A collapsible apparatus for recovering and dispensing packaging material and constructed according to the preferred teachings of the present invention is shown in the drawings and generally designated 10. The collapsible apparatus 10 of the present invention includes a receptacle 20 to store the packaging material. The receptacle 20 according to the preferred teachings of the present invention is permeable to air and is collapsible. In the preferred form according to the preferred teachings of the present invention, the receptacle 20 is cylindrical and is made from a deformable material such as, but not limited to, canvas. The receptacle 20 in the preferred form has an upper end 22 that is held in a circular shape by a ring 24 attached inside the upper end 22.

A disc 30 according to the preferred teachings of the present invention forms a lower end of the receptacle 20. The disc 30 is circular and has a surface 32 and a disc diameter parallel the surface 32. The surface 32 of the disc 30 is horizontal, and the packaging material when received in the receptacle 20 gravitationally rests on the surface 32. In the most preferred form according to the preferred teachings of the present invention, the upper end 22 of the receptacle 20 has a radial slit 26 parallel the surface 32 of the disc 30 to enhance the permeability and collapsibility of the receptacle 20.

The disc 30 has a hole 34 through which a collection tube 36 is slideably received. The collection tube 36 has an inlet 38 and an outlet 40. The inlet 38 is located outside the receptacle 20 when the collection tube 36 is received in the disc 30. The outlet 40 of the collection tube 36 is located inside the receptacle 20 when the collection tube 36 is received in the disc 30.

In the preferred form according to the preferred teachings of the present invention, the collection tube 36 has a rigid portion 50 that is generally inside the receptacle 20 and defines the outlet 40 of the collection tube 36. The rigid portion 50 is formed of pipe, such as PVC pipe, in the most preferred form according to the preferred teachings of the present invention. Also, in the most preferred form, the rigid portion 50 extends perpendicular the surface 32 of the disc 30 towards the upper end 22 of the receptacle 20 and terminates with an elbow 52. A terminal portion inside of the elbow 52 in the most preferred form is cut back to define the outlet 40 and facilitate free flow of the packaging material through the outlet 40 and into the receptacle 20. Although in the most preferred form according to the preferred teachings of the present invention, the elbow 52 is shown in the order of 90-degrees and the terminal portion is cut back to an angle in the order of 45-degrees, the elbow 52 could be of a different angle or orientation, and the terminal portion could be cut back to differing angles or shapes without departing from the spirit or scope of the present invention.

In the most preferred form according to the preferred teachings of the present invention, a rope 54 extends through the slit 26 of the receptacle 20 and is attached to the elbow 52. The rope 54 can be tied to an overhead support to hold the rigid portion 50 of the collection tube 36 perpendicular to the surface 32 of the disc 30. In particular, the top surface of elbow 52 abuts with the upper end 22 of the receptacle 20 on opposite sides of the slit 26 to thereby support the upper end 22 of the receptacle 20, with the receptacle 20 extending downward from the upper end 22. In the preferred form according to the preferred teachings of the present invention, the disc diameter of disc 30 corresponds to a ring diameter of the ring 24, and the disc 30 cooperates with the ring 24 to hold the receptacle 20 in a cylindrical shape when the receptacle 20 is extended to receive the packaging material. In the preferred form, the disc 30 (and components mounted thereto and/or supported thereon) are supported by receptacle 20.

A flexible portion 56 of the collection tube 36, in the preferred form according to the preferred teachings of the present invention, is formed of flexible tubing and defines the inlet 38 of the collection tube 36. In the most preferred form according to the preferred teachings of the present invention, the inlet 38 of the collection tube 36 is removably attachable to an exterior 58 of the receptacle 20 for positioning the flexible portion 56 out of the way when the collection tube 36 is not being used. The flexible portion 56 can be removably attached by fasteners such as, but not limited to, hook and loop fasteners or by hanging onto a bracket.

A fan 60 is mounted to the disc 30 to move air from outside the receptacle 20 to inside the receptacle 20 according to the preferred teachings of the present invention. The fan 60 has fan blades mounted inside a fan passageway 62. The fan passageway 62 extends through the disc 30 and opens into the collection tube 36. The fan 60, when operating, forces air through the fan passageway 62 and into the collection tube 36. The air enters the collection tube 36 and is aimed toward the outlet 40 of the collection tube 36 to create a vacuum at the inlet 38 of the collection tube 36. The inlet 38 of the collection tube 36 uses the vacuum to collect the packaging material. The packaging material is pulled by the vacuum through the collection tube 36 and deposited into the receptacle 20 where the packaging material is stored for future discharge.

In the preferred form according to the preferred teachings of the present invention, the fan passageway 62 has a cavity 65 in which the fan blades are located. Also in the preferred form, the fan passageway 62 has a narrow tube 66 that is flexible and communicates the cavity 65 with the collection tube 36. The narrow tube 66 has a tube diameter smaller than a cavity diameter of the cavity 65 to increase air speed as delivered to the collection tube 36. Increased air speed into the collection tube 36 increases the vacuum created at the inlet 38 of the collection tube 36 when the fan 60 is operating.

In the preferred form according to the preferred teachings of the present invention, the fan passageway 62 extends outside of the receptacle 20 to locate the fan blades outside the receptacle 20. Also, in the preferred form, the fan blades of the fan 60 rotate about an axis that is perpendicular to the surface 32 of the disc 30. An intake valve 72 is provided and is adjustable to control airflow into the fan 60, which in turn, proportionally affects the vacuum created in the collection tube 36. The intake valve 72 is on an intake side 74 of the fan 60 and is external the receptacle 20 in the preferred form. A switch 76 controls power to the fan 60 and is accessible external the receptacle 20 in the preferred form according to the preferred teachings of the present invention.

According to the preferred teachings of the present invention, a discharge passage 80 extends through the disc 30 from inside to outside the receptacle 20. The discharge passage 80, according to the preferred teachings of the present invention, has a discharge valve 81, which can be moved between an open position and a closed position. When in the closed position, the discharge valve 81 blocks the discharge passage 80 to retain the packaging material in the receptacle 20. When moved to the open position, the discharge valve 81 allows discharge of stored packaging material from inside to outside the receptacle 20. In the preferred form according to the preferred teachings of the present invention, the discharge valve 81 can be manually operated from outside the receptacle 20. An operator can also operate the fan 60 to further assist in dispensing the packaging material when the discharge valve 81 is open.

In the preferred form according to the preferred teachings of the present invention, the discharge valve 81 is a scissors valve having a first blade 82 slidingly mounted in a housing 84. In the most preferred form, the discharge valve 81 additionally has a second blade 83 that is also slidingly mounted in the housing 84. The housing 84 is mounted in the discharge passage 80 and in the preferred form is generally cylindrical. The housing 84 has a periphery 85 and an axis that is generally perpendicular the surface 32 of the disc 30. A slot 86 in the periphery 85 of the housing 84 extends from exterior to interior the housing 84. The slot 86 extends perpendicular the axis of the housing 84. The slot 86 has a length along the periphery 85 in a plane perpendicular the axis of the housing 84. The first blade 82 and the second blade 83 are exterior the disc 30 and slideable within the slot 86 in the plane perpendicular the axis. The first blade 82 has a first edge 87 and a first handle 88. Similarly, the second blade 83 has a second edge 89 and a second handle 90. When the discharge valve 81 is in the closed position, the first edge 87 and the second edge 89 are adjacent each other to effectively block the discharge passage 80 and retain the packaging material in the receptacle 20. In the preferred form according to the preferred teachings of the present invention, a spring 95 biases the discharge valve 81 to the closed position. In the most preferred form according to the preferred teachings of the present invention, the spring 95 is a torsion spring attached between the first blade 82 and the second blade 83. Also, in the most preferred form according to the preferred teachings of the present invention, the first edge 87 and the second edge 89 are generally linear. When the discharge valve 81 is in the closed position, the first edge 87 and the second edge 89 are adjacent each other both interior the housing 84 and to a point proximate the spring 95, in the preferred form. In the most preferred form, the first blade 82 is generally planar and has a semi-circular side 92. When the discharge valve 81 is in the closed position, the semi-circular side 92 lines up flush with the periphery 85 of the housing 84. Also, in the most preferred form, the first edge 87, the semi-circular side 92, and the first handle 88 together form a perimeter of the first blade 82 in the plane perpendicular the axis of the housing 84. The second blade 83 is symmetrical and substantially identical to the first blade 82 in the most preferred form according to the preferred teachings of the present invention. Although, in the preferred form, the first and second blades 82 and 83 are formed of a solid material, such as from plastic, it would be obvious to one skilled in the art that the first and second blades 82 and 83 could be wholly or partially formed of mesh or screen to retain the packaging material according to the preferred teachings of the present invention. Similarly, the first and second edges 87 and 89 could be nonlinear or could have less than continuous contact to block the discharge passages when the discharge valve 81 is in the closed position without departing from the spirit or scope of the present invention.

When the discharge valve 81 is in the closed position, the first handle 88 is spaced from the second handle 90 in the preferred form according to the preferred teachings of the present invention. In the most preferred form according to the teachings of the present invention, an angle in the order of 60 degrees is formed between the first and second handles 88 and 90 when the first edge 87 is adjacent the second edge 89. The first and second handles 88 and 90, in the preferred form, can be pressed together by the operator and move in the plane perpendicular the axis of the housing 84. The first and second blades 82 and 83, when the first and second handles 88 and 90 are pressed together, rotate about a first pivot point 93 and a second pivot point 94, respectively. The first pivot point 93 is located on the first blade 82 intermediate the first edge 87 and the first handle 90. The second pivot point 94 is located on the second blade 83 intermediate the second edge 89 and the second handle 90. The first and second pivot points 93 and 94 are rotatably linked to each other and spaced a fixed distance apart to cause the first and second edges 87 and 89 to move away from each other in the plane perpendicular the axis when the first and second handles 88 and 90 are pressed together thus moving the discharge valve 81 to the open position. In the most preferred form according to the preferred teachings of the present invention, the first and second pivot points 93 and 94 and the first and second handles 88 and 90 are located exterior the periphery 85 of the housing 84 for access by the operator. Also, in the most preferred form, the spring 95 presses the first handle 88 away from the second handle 90 to bias the discharge valve 81 to the closed position.

A first guide slot 96 extends through the first blade 82 parallel the axis of the housing 84 in the most preferred form according to the preferred teachings of the present invention. The first guide slot 96 is arcuate and has a first arcuate length in the plane perpendicular the axis of the housing 84. A first guide pin 98 is mounted through the housing 84 and through the first guide slot 96 to hold the first blade 82 in the slot 86. The first guide pin 98 extends through the slot 86 in the periphery 85 of the housing 84 and is stationary relative to the housing 84. The first guide slot 96 is slideable relative to the first guide pin 98 and the first guide pin 98 limits sliding movement of the first blade 82 to the first arcuate length of the first guide slot 96. The first arcuate length is sized to allow rotation of the first blade 82 to adjust the discharge valve 81 between the open position and the closed position.

In the most preferred form according to the preferred teachings of the present invention, the second blade 83 is symmetrical and identical to the first blade 82 and includes a second guide slot 97 having a second arcuate length. The second blade 83 also has a second guide pin 99. The second blade 83 in the most preferred form functions similar to the first blade 82 and is slideable relative to the second guide pin 99 within the second arcuate length of the second guide slot 97.

As will be recognized by those skilled in the art according to the teachings of the present invention, the second edge 89 and the second handle 90 could be fixed relative to the housing 84 with rotation of the first blade 82 defining the open and closed positions of the discharge valve 81, without requiring movement of the second blade 83.

In the most preferred form according to the preferred teachings of the present invention, a portion 100 of the fan passageway 62 can be molded as an integral part of the disc 30 and then cut from the disc 30 thereby forming the hole 34 in the disc 30. The portion 100 of the fan passageway 62 after being cut from the disc 30 can be relocated and attached to the disc 30 by fasteners such as screws. While forming the portion 100 of the fan passageway 62 as part of the disc 30 is efficient and eases manufacture, the fan passageway 62 could be formed separately from the disc 30 or mounted to the disc 30 with other types of fasteners according to the preferred teachings of the present invention.

According to the preferred teachings of the present invention, the receptacle 20 is collapsible, and in the preferred form, the collection tube 36 is moveable when received in the disc 30 to position the rigid portion 50 parallel the surface 32 of the disc 30. The rigid portion 50 of the collection tube 36 in the most preferred form according to the preferred teachings of the present invention is passable through the radial slit 26 to facilitate collapsing the receptacle 20 and positioning of the rigid portion 50 parallel the surface 32. In the preferred form according to the preferred teachings of the present invention, the rigid portion 50 of the collection tube 36 when positioned parallel the surface 32 cooperates with the disc 30 carrying the discharge valve 81, the fan 60 and the collection tube 36 to allow compactibility to a collapsed state for ease of packing and shipping the collapsible apparatus 10. Furthermore, by tying the rope 54 to the overhead support and plugging the fan 60 into a power source, the collapsible apparatus 10, in the preferred form according to the preferred teachings of the present invention, can be quickly converted from the collapsed state to be ready to use without necessitating further assembly.

Now that the basic teachings of the present invention have been explained, many extensions and variations will be obvious to one having ordinary skill in the art. For example, although the collapsible apparatus 10 according to the preferred teachings of the present invention has been shown as including several features in a combination believed to produce synergistic results, such features can be utilized singly and in other combinations with other features according to the preferred teachings of the present invention. For example, the disc 30 could carry the discharge valve 81 of the preferred form or of other forms, the fan 60 and the collection tube 36 without the rigid portion 50 of the collection tube 36 being positionable to be parallel the surface 32 of the disc 30 without departing from the spirit or scope of the present invention.

Furthermore, the discharge valve 81 of the scissors valve type such as having first and second blades 82 and 83 which are moveable and guided by the first and second guide pins 98 and 99 and the first and second guide slots 96 and 97 of the preferred form, could be mounted in the receptacle 20 without the disc 30 or with a disc which does not mount the fan 60 and/or the collector tube 36 according to the teachings of the present invention.

Thus since the invention disclosed herein may be embodied in other specific forms without departing from the spirit of general characteristics thereof, some of which forms have been indicated, the embodiment described herein is to be considered in all respects illustrative and not restrictive. The scope of the invention is to be indicated by the appended claims, rather than by the foregoing description, and all changes which come within the meaning and ranges of equivalency of the claims are intended to be embraced therein.

What is claimed is:

1. Collapsible apparatus for recovering and dispensing packaging material comprising, in combination:

a receptacle having a lower end, with the receptacle being permeable to air and collapsible;

a disc defining the lower end of the receptacle, with the disc having a surface that is horizontal, with the packaging material gravitationally resting on the surface of the disc when the packaging material is received in the receptacle;

a collection tube having an inlet and an outlet, with the disc having a hole, with the collection tube being slideably received in the hole, with the outlet when the collection tube is received in the hole of the disc being inside the receptacle, with the inlet when the collection tube is received in the hole of the disc being outside the receptacle;

a fan mounted to the disc and including fan blades inside a fan passageway, with the fan passageway extending through the disc from outside the receptacle to inside the receptacle, with the fan when operating forcing air from outside the receptacle through the fan passageway and into the collection tube, with the air being forced toward the outlet of the collection tube and creating a vacuum at the inlet of the collection tube, with the inlet of the collection tube adapted to collect the packaging material and with the packaging material being pulled through the collection tube by the vacuum created when the fan is operating, with the outlet adapted to deposit the packaging material in the receptacle for storage and future discharge; and a discharge passage extending through the disc from inside to outside the receptacle, with the discharge passage having a discharge valve moveable between an open position and a closed position, with the discharge valve in the open position allowing discharge of stored packaging material from inside the receptacle to outside the receptacle, with the discharge valve in the closed position effectively blocking the discharge passage to retain the packaging material in the receptacle.

2. The collapsible apparatus of claim 1 further comprising, in combination: a rope attached to the collection tube, with the receptacle having an upper end, with the rope adapted to be tied to an overhead support to hold the collection tube perpendicular the surface of the disc, and with the collection tube abutting with the upper end of the receptacle to extend and support the receptacle for receiving the packaging material.

3. The collapsible apparatus of claim 2 with the collection tube comprising, in combination:

a flexible portion defining the inlet, with the flexible portion being generally outside the receptacle when the collection tube is received in the disc; and a rigid portion, with the rigid portion being generally inside the receptacle and extending generally perpendicular the surface of the disc when the collection tube is received in the disc, with the collection tube moveable to position the rigid portion parallel the surface of the disc, with the fan passageway bendable to facilitate positioning of the rigid portion, with the disc carrying the discharge valve, the fan, and the collection tube and with the receptacle being collapsible to enhance compactibility.

4. The collapsible apparatus of claim 3 with the rigid portion of the collection tube being formed of PVC pipe, with the outlet of the collection tube having an elbow defining the outlet and to facilitate free flow of the packaging material into the receptacle, with the rope being attached to the elbow of the collection tube.

5. The collapsible apparatus of claim 4 further comprising, in combination: a ring attached to the upper end of the receptacle and holding the upper end of the receptacle in a circular shape, with the ring having a ring diameter corresponding to a disc diameter of the disc, with the ring and the disc when the rope is tied to the overhead support cooperating to hold the receptacle in a cylindrical shape.

6. The collapsible apparatus of claim 5 with the upper end of the receptacle being formed of a deformable material and having a radial slit parallel the surface of the disc when the receptacle is held in the cylindrical shape, with the rope when tied to the overhead support passing through the radial slit, with the radial slit enhancing permeability of the receptacle, with the rigid portion of the collection tube passable through the radial slit to facilitate collapsing of the receptacle.

7. The collapsible apparatus of claim 3 with the inlet of the collection tube being removably and replaceably attachable to an exterior of the receptacle for positioning the flexible portion of the collection tube out of the way when not in use.

8. The collapsible apparatus of claim 1 with the fan blades of the fan being rotatable about an axis perpendicular the surface of the disc, with the fan passageway extending outside of the receptacle and with the fan blades contained in the fan passageway being outside of the receptacle.

9. The collapsible apparatus of claim 1 with the fan further comprising, in combination:

an intake valve which is adjustable and controls airflow into the fan, with airflow into the fan affecting vacuum created in the collection tube; and a switch on the fan controlling power to the fan and adapted to be accessible by an operator external the receptacle.

10. The collapsible apparatus of claim 9 with the intake valve being on an intake side of the fan, with the intake side of the fan being outside the receptacle.

11. The collapsible apparatus of claim 1 further comprising, in combination:

a cavity defined in the fan passageway, with the fan blades being located in the cavity, with the cavity having a cavity diameter perpendicular airflow in the cavity; and a narrow tube defined in the fan passageway and communicating the cavity with the collection tube, with the narrow tube being flexible and having a tube diameter perpendicular airflow in the narrow tube, with the tube diameter of the narrow tube being smaller than the cavity diameter of the cavity, with the narrow tube increasing air speed from the cavity to the collection tube when the fan is operating.

12. The collapsible apparatus of claim 1 with the discharge valve comprising, in combination:

a housing, with the housing being mounted in the discharge passage, with the housing being generally cylindrical and having a periphery and an axis, with the axis of the housing being generally perpendicular the surface of the disc, with the periphery of the housing having a slot extending from exterior to interior the housing in a plane perpendicular the axis, with the slot having a length along the periphery of the housing, with the length of the slot being in the plane perpendicular the axis; and at least a first blade, with the first blade slidingly mounted in the slot of the housing, with the first blade being slideable in the plane perpendicular the axis, with the first blade having a first edge, a first handle and a first pivot point intermediate the first edge and the first handle, with the first handle of the first blade being exterior the periphery of the housing, with the first blade being rotatable about the first pivot point and perpendicular the axis, with the discharge valve having a second handle, with the second handle being exterior the periphery of the housing, with the first handle being spaced from the second handle when the discharge valve is in the closed position and with the first handle adapted to be pressed toward the second handle by an operator, with the first handle when pressed toward the second handle moving perpendicular the axis and rotating the first blade about the first pivot point, with the discharge valve moving from the closed position to the open position when the first handle moves toward the second handle.

13. Collapsible apparatus for recovering and dispensing packaging material comprising, in combination:

a receptacle adapted to receive the packaging material, with the receptacle being permeable to air and having a lower end, with the packaging material gravitationally resting on the lower end when the packaging material is received in the receptacle;

a collection tube adapted to deposit the packaging material in the receptacle for storage and future discharge;

a discharge passage extending through the lower end of the receptacle from inside to outside the receptacle; and a discharge valve mounted in the discharge passage, with the discharge valve being moveable between an open position and a closed position, with the discharge valve in the open position allowing discharge of stored packaging material from inside the receptacle to outside the receptacle, with the discharge valve in the closed position effectively blocking the discharge passage to retain the packaging material in the receptacle, with the discharge valve having a housing mounted in the discharge passage, with the housing having an axis and a periphery, with the axis of the housing being generally perpendicular the lower end of the receptacle, with the periphery of the housing having a slot extending from exterior to interior the housing in a plane perpendicular the axis of the housing, with the slot having a length along the periphery of the housing, with the length of the slot being in the plane perpendicular the axis, with the discharge valve having at least a first blade, with the first blade slidingly mounted in the slot of the housing, with the first blade being slideable in the plane perpendicular the axis, with the first blade having a first edge, a first handle and a first pivot point intermediate the first edge and the first handle, with the first handle of the first blade being exterior the periphery of the housing, with the first blade being rotatable about the first pivot point and perpendicular the axis, with the discharge valve having a second handle, with the second handle being exterior the periphery of the housing, with the first handle being spaced from the second handle when the discharge valve is in the closed position and with the first handle adapted to be pressed toward the second handle by an operator, with the first handle when pressed toward the second handle moving perpendicular the axis and rotating the first blade about the first pivot point, with the discharge valve moving from the open position to the closed position when the first handle moves toward the second handle.

14. The collapsible apparatus of claim 13 further comprising, in combination: a second blade mounted in the housing, with the second blade defining a second edge and including the second handle, with the first edge of the first blade when adjacent the second edge effectively blocking the discharge passage and defining the closed position of the discharge valve.

15. The collapsible apparatus of claim 14 further comprising, in combination: a torsion spring mounted intermediate the first blade and the second blade proximate the first pivot point, with the torsion spring biasing the first handle away from the second handle to bias the discharge valve to the closed position.

16. The collapsible apparatus of claim 14 with the discharge valve further comprising, in combination:

a first guide slot in the first blade, with the first guide slot extending through the first blade generally parallel the axis of the housing, with the first guide slot being arcuate and having a first arcuate length in the plane perpendicular the axis of the housing; and a first guide pin mounted parallel the axis of the housing, with the first guide pin extending through the first guide slot, with the first guide pin when mounted being stationary relative to the slot and retaining the first blade in the slot, with the first guide slot being slideable relative to the first guide pin, with the first guide pin limiting sliding movement of the first blade to the first arcuate length of the first guide slot, with the first arcuate length sized to allow rotation of the first blade to move the discharge valve between the open position and the closed position, with the discharge valve being biased to the closed position.

17. The collapsible apparatus of claim 16 with the discharge valve further comprising, in combination:

a second guide slot in the second blade, with the second guide slot extending through the second blade parallel the axis of the housing, with the second guide slot being arcuate and having a second arcuate length in the plane perpendicular the axis of the housing, with the second blade being slidingly mounted in the slot of the housing, with the second blade having a second pivot point intermediate the second handle and the second edge, with the second blade being rotatable about the second pivot point in the plane perpendicular the axis, with the second handle adapted to be pressed toward the first handle by the operator, with the second handle when pressed toward the first handle moving in the plane perpendicular the axis and rotating the second blade about the second pivot point, with the second edge moving away from the first edge in the plane perpendicular the axis when the second handle moves toward the first handle; and a second guide pin mounted parallel the axis of the housing, with the second guide pin extending through the second guide slot, with the second guide slot when mounted being stationary relative to the slot and retaining the second blade in the slot, with the second guide slot being slideable relative to the second guide pin, with the second guide pin limiting sliding movement of the second blade to the second arcuate length of the second guide slot, with the second arcuate length sized to allow rotation of the second blade to move the discharge valve between the open position and the closed position.

18. The collapsible apparatus of claim 17 with the first blade and the second blade being substantially identical and symmetrical about the first edge and the second edge, with both the first blade and the second blade being slideable within the slot of the housing of the discharge valve when the first handle and the second handle are pressed together.

19. The collapsible apparatus of claim 13 with the first blade being generally planar and having a semi-circular side, with the housing being cylindrical about the axis, with the semi-circular side being flush with the periphery of the housing when the discharge valve is in the closed position, with the first edge, the semi-circular side, and the first handle in combination defining a perimeter of the first blade in the plane perpendicular the axis.

20. The collapsible apparatus of claim 13 further comprising, in combination: a fan mounted to the lower end of the receptacle and including fan blades and a fan passageway, with the fan blades being inside the fan passageway, with the fan passageway extending through the lower end from outside the receptacle to inside the receptacle, with the fan when operating forcing air from outside the receptacle through the fan passageway and into the collection tube, with the collection tube passing through the receptacle and having an inlet outside the receptacle and an outlet inside the receptacle, with the air being forced toward the outlet of the collection tube and creating a vacuum at the inlet of the collection tube.

* * * * *